US009080358B2

(12) United States Patent
Graf

(10) Patent No.: US 9,080,358 B2
(45) Date of Patent: Jul. 14, 2015

(54) HINGE ASSEMBLY

(75) Inventor: Alexander Graf, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 127 days.

(21) Appl. No.: 14/003,008

(22) PCT Filed: Feb. 10, 2012

(86) PCT No.: PCT/EP2012/052321

§ 371 (c)(1),
(2), (4) Date: Sep. 4, 2013

(87) PCT Pub. No.: WO2012/119833

PCT Pub. Date: Sep. 13, 2012

(65) Prior Publication Data

US 2014/0000062 A1 Jan. 2, 2014

(30) Foreign Application Priority Data

Mar. 10, 2011 (DE) ..... 10 2011 005 336

(51) Int. Cl.
*E05D 11/00* (2006.01)
*G08B 13/08* (2006.01)

(52) U.S. Cl.
CPC ..... *E05D 11/0081* (2013.01); *G08B 13/08* (2013.01); *E05Y 2400/616* (2013.01); *E05Y 2400/66* (2013.01); *E05Y 2900/132* (2013.01); *E05Y 2900/20* (2013.01); *Y10T 16/522* (2015.01)

(58) Field of Classification Search
CPC ..... E05D 11/0081; Y10T 16/522; E05Y 2400/616; E05Y 2400/66; G08B 13/08
See application file for complete search history.

(56) References Cited

U.S. PATENT DOCUMENTS

| | | | | | |
|---|---|---|---|---|---|
| 1,029,281 | A | * | 6/1912 | Davis | 340/545.2 |
| 3,715,537 | A | * | 2/1973 | Peterson | 200/61.7 |
| 3,772,669 | A | * | 11/1973 | Johnston et al. | 327/304 |
| 3,806,852 | A | * | 4/1974 | Suska | 335/205 |

(Continued)

FOREIGN PATENT DOCUMENTS

| | | | |
|---|---|---|---|
| DE | 24 36 225 | A1 | 2/1975 |
| DE | 195 22 885 | A1 | 1/1997 |

OTHER PUBLICATIONS

German Search Report Corresponding to 10 2011 005 336.0 mailed Sep. 6, 2011.

(Continued)

*Primary Examiner* — Jeffrey O Brien
(74) *Attorney, Agent, or Firm* — Davis & Bujold, P.L.L.C.; Michael J. Bujold

(57) ABSTRACT

A hinge assembly comprising a hinge and an autonomous remote switch unit. The hinge comprises two hinge parts that are connected by an intermediate joint of which a first hinge part is connected to a stationary component, and a second hinge part is coupled via the joint to a pivoting element, especially a door, to pivot relative to the first hinge part, and the autonomous remote switch unit comprises a radio unit and a generator unit having an actuation element that transmits an opening and closing of the hinge to the generator unit such that the generator unit induces an electrical current pulse to supply power to the radio unit. The generator unit induces an electrical current pulse both during transmission of the opening and closing of the hinge by the actuation element, and the radio unit transmits data when power is thereby supplied.

7 Claims, 4 Drawing Sheets

(56) References Cited

U.S. PATENT DOCUMENTS

| | | | | |
|---|---|---|---|---|
| 3,980,996 | A * | 9/1976 | Greenspan et al. | 340/539.3 |
| 4,049,934 | A * | 9/1977 | Newlon | 200/61.7 |
| 4,066,857 | A * | 1/1978 | Suska | 200/61.7 |
| 4,168,409 | A * | 9/1979 | McNinch | 200/61.7 |
| 7,522,042 | B2 * | 4/2009 | Milo | 340/545.1 |
| 7,752,713 | B2 * | 7/2010 | Stura et al. | 16/387 |

OTHER PUBLICATIONS

International Search Report Corresponding to PCT/EP2012/052321 mailed Apr. 20, 2012.
Written Opinion Corresponding to PCT/EP2012/052321 mailed Apr. 20, 2012.
International Preliminary Report Corresponding to PCT/EP2012/052321 mailed Feb. 13, 2013.

* cited by examiner

HINGE ASSEMBLY

This application is a National Stage completion of PCT/EP2012/052321 filed Feb. 10, 2012, which claims priority from German patent application serial no. 10 2011 005 336.0 filed Mar. 10, 2011.

FIELD OF THE INVENTION

The invention relates to a hinge assembly comprising a hinge, especially a cup hinge, and an autonomous remote switch unit, wherein the hinge is composed of two hinge parts that are connected by an intermediate joint of which a first hinge part is connected to a stationary component, and a second hinge part is coupled via the joint to a pivoting element, especially a door, to pivot relative to the first hinge part, and wherein the autonomous remote switch unit comprises a radio unit and a generator unit having an actuation element that transmits an opening and closing of the hinge to the generator unit such that the generator unit induces an electrical current pulse to supply power to the radio unit.

BACKGROUND OF THE INVENTION

Hinge assemblies are used for door systems or items of furniture, for example, in order to open and close doors or flaps. Frequently, contact switches are provided in the region of a hinge of the respective hinge assembly that detect opening and closing of the hinge, and hence a corresponding movement of the associated door or flap. By means of this detection of the hinge movement, certain functions can then be activated, such as light applications or safety-relevant functions.

A hinge assembly is known from DE 24 36 225 A1 which is used as a safety device in the region of a door. This hinge assembly comprises a hinge that is composed of two hinge parts connected by an intermediate joint. In the region of a first, fixed hinge part, there is an autonomous remote switch unit which is composed of a radio unit and a generator unit. The radio unit and the generator unit are each accommodated in cylindrical housings and extend orthogonally to the first hinge part in a direction opposite the second, movable hinge part. The generator unit has an actuation element which extends through a cutout in the first hinge part toward the second hinge part that it contacts when the hinge closes. A cylindrical permanent magnet is thereby shifted and locked into a standby position within the generator unit. If the door, and hence the hinge as well, is opened, the actuation element of this generator unit is moved back into a home position by means of an integrated spring and entrains the cylindrical permanent magnet along with it at the end of the movement. The cylindrical magnet is then suddenly moved to the middle of a coil pack which causes the induction of an electrical current pulse, by means of which current is supplied to the radio unit. When power is supplied, the radio unit transmits a signal at a specific frequency, whereby an opening of the door corresponding to the signal is detected in a receiver unit to the side of the hinge assembly. A security system can thereby be formed by means of which opening of the door is detected by an autonomous remote switch unit.

SUMMARY OF THE INVENTION

Proceeding from a prior art hinge assembly, it is the object of the present invention to provide a hinge assembly in which an opening and closing of a hinge can be reliably detected in a space-saving manner and transmitted as a signal.

According to the invention, the hinge assembly comprises a hinge and an autonomous remote switch unit, wherein the hinge is composed of two hinge parts connected by an intermediate joint. In particular, the hinge is designed in this case as a cup hinge in which a first hinge part is formed as a hinge arm that is connected to a stationary component such as an item of furniture or a door frame, whereas a second hinge part that can pivot relative to the first hinge part is formed as a hinge cup which is flush-mounted in a body, such as a door or flap, which can pivot relative to the fixed element. In the context of the invention, however, other embodiments of the hinges are also conceivable—in the simplest case, by two screw-mounted surfaces connected by means of an intermediate joint. The autonomous remote switch unit comprises a radio unit and a generator unit equipped with an actuation element, wherein an opening and closing of the hinge is transmitted by the actuation element to the generator unit where it triggers the induction of an electrical current pulse to supply power to the radio unit. The generator unit in the context of the invention can either be designed as an electrodynamic or piezoelectric converter that converts the mechanical movement of the actuation element into a current pulse. It is possible to use transmission units as the radio unit, by means of which data packages, in particular, can be transmitted in high-frequency signals.

The invention comprises the technical teaching that the generator unit induces an electrical current pulse, both when the hinge closes and opens, from the movement transmitted to it by the actuation element, and the current pulse then supplies current to the radio unit which then transmits data. Since the generator unit induces an electrical current pulse for both of the directions of movement of the associated hinge, these movements can be detected by a single autonomous remote switch unit in a compact manner. By then transmitting data to a higher level receiver system, numerous subsequent functions can be linked to the detected movements of the hinge. According to the invention, the radio unit transmits, in particular, data packages similar to a wireless network (WLAN), whereby the transmission of additional information beyond the movement of the hinge is also conceivable. In particular, it is possible to transmit an ambient temperature that has been detected by a temperature sensor integrated in the radio unit or disposed adjacent thereto.

In contrast in DE 24 36 225 A1, it is only possible to induce a current pulse when opening the hinge. Furthermore, the radio unit in this case only sends one signal in the form of a specific frequency which greatly restricts transmission of information and the control of subsequent functions. In addition, transmitting a signal at a specific frequency in combination with other existing radio systems sometimes causes problematic overlapping.

According to one embodiment of the invention, the autonomous remote switch unit is disposed on the first hinge part, the actuation element coming into contact with the second hinge part or the element to be pivoted when the hinge closes. The advantage of disposing the autonomous remote switch unit on the stationary component is that the number of moved components can be kept low while simultaneously detecting an opening and closing of the hinge. Disposing the autonomous remote switch unit on the first hinge part is to be understood as placing the remote switch unit on the first hinge part to the side of a plane formed by the two hinge parts when the hinge opens and closes, or also placing the remote switch unit on the first hinge part within this plane.

In a development of this embodiment, a transmission element is placed between the second hinge part, or the element to be pivoted and the actuation element, the transmission element establishing contact when the hinge closes between the second hinge part and the actuation element, or the element to be pivoted and the actuation element. Transmitting the movement of the hinge to the actuation element by means of the transmission element also allows the autonomous remote switch unit to be at further distance from the second hinge part, or the element to be pivoted, which enables a more individual arrangement depending on the given space conditions.

The transmission element is advantageously movably guided on the first hinge part in a slot and transmits the closing of the hinge by moving in the slot toward the actuation element. This guide in the first hinge part allows a reliable transmission of the movement to be realized. Corresponding to a particularly advantageous embodiment, the transmission element in the slot moves against a spring when the hinge closes and thereby actuates the actuation element by means of a contour. The advantage is that the spring thereby dampens a movement of the transmission element when the hinge closes, and thereby also causes a dampening of a closing movement of the element to be pivoted. By controlling the actuation element of the generator unit by means of the contour of the transmission element, it is possible to largely decouple from the hinge damping which is thereby generated.

According to another advantageous embodiment of the invention, the transmission element is placed in a common housing with the autonomous switch unit. This can prevent undesired impairment of the transmission element and the autonomous remote switch unit.

Corresponding to an alternative embodiment of the present invention, the transmission element is formed on the second hinge part or element to be pivoted, and has a curved contour. A closing movement of the hinge can also be reliably transmitted to the actuation element of the generator element by means of such an embodiment. The curved contour of the transmission element allows a smooth actuation of the generator unit to be realized by means of the pivoting movement of the second hinge part and the element to be pivoted. A curvature of the contour should correspond to an effective pivoting radius in the region where the transmission element is placed.

As an additional alternative, the autonomous remote switch unit is integrated in a recess of the second hinge part, wherein the actuation element comes into contact with the first hinge part, or the stationary component, when the hinge closes. The advantage is that integration in the second hinge part enables an extremely compact design of a hinge assembly with an independent remote switch unit.

In a development of the initially cited variation, the generator unit is designed as an electrodynamic generator with a coil pack and a magnet block. The coil pack is oriented perpendicular to the direction of actuation of the actuation element, and the magnet block, by moving across the actuation element, induces a current pulse in the coil pack by an associated polarity reversal of a coil core. A compact embodiment of a generator unit can be achieved by orienting the coil pack in a perpendicular direction relative to the direction the actuation of the magnet block. Overall, this enables problem-free placement in the region of one of the two hinge parts.

Corresponding to another advantageous embodiment of the invention, the actuation element of the generator unit is designed as a spring-mounted tongue. When the hinge opens, this also advantageously generates a movement in the generator unit which triggers a current pulse in that the spring-mounted tongue ensures a return movement of moved parts. Furthermore, with a corresponding embodiment, the spring-mounted tongue can also be designed as a stop damper for the hinge.

The invention is not restricted to the specified combination of features of the main switch or the dependent claims. Furthermore, there are options for combining individual features with each other from the claims, subsequent description of the embodiments, or directly from the drawings. The reference in the claims to the drawings by the use of reference numbers does not restrict the scope of protection of the claims.

BRIEF DESCRIPTION OF THE DRAWINGS

Along with the description of preferred embodiments of the invention, additional measures for improving the invention will be described in greater detail below with reference to the figures. They show.

DETAILED DESCRIPTION OF THE PREFERRED EMBODIMENTS

Figure 1A:
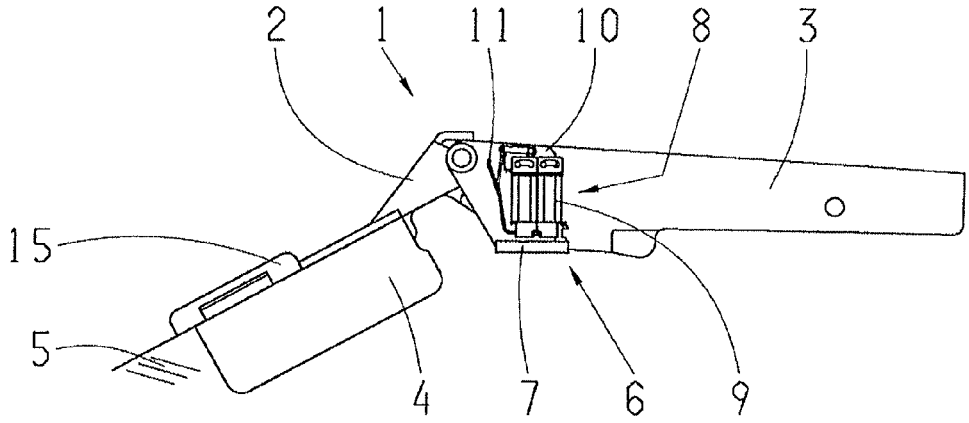
FIG. 1A to 1CA side view of a first preferred embodiment of the hinge assembly according to the invention shown in an open and closed state of the hinge assembly as well as a transition between these two states.
Figure 1B:
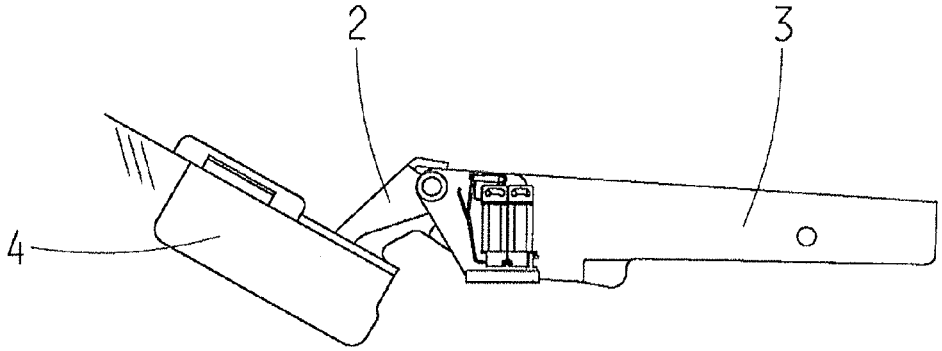
Figure 1C:
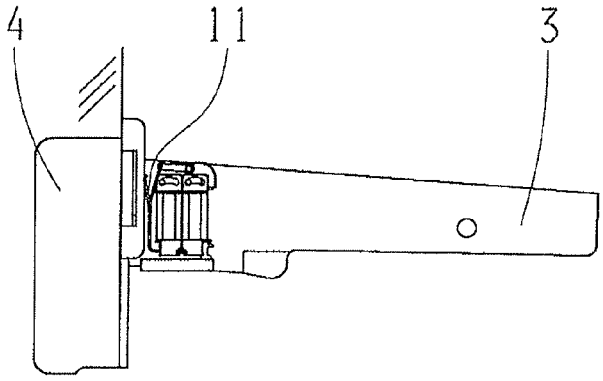

FIG. 1A to 1C disclose a first preferred embodiment of the hinge assembly according to the invention. This hinge assembly comprises a hinge 1 that is composed of two hinge parts 3 and 4 connected to each other by an intermediate joint 2. The first hinge part 3 is connected to a stationary component (not shown), whereas the second hinge part 4 is coupled to a element to be pivoted, a door 5 in the present case. Instead of the door 5, the element to be pivoted can also be a flap or another element which closes an opening. The fixed element can be an item of furnishing such as a piece of furniture or a general component that bears a door such as a doorframe.

As can additionally be seen in FIG. 1A to 1C, the hinge 1 in the present case is designed as a cup hinge, wherein the first hinge part 3 in this case functions as a hinge arm, and the second hinge part 4 functions as a hinge cup that is inserted in a corresponding recess of the door 5. The door 5 can be moved by means of the hinge 1 from the open position shown in FIG. 1A across the intermediate position shown in FIG. 1B into a closed position visible in FIG. 1C by closing the hinge 1, and back by opening the hinge 1. By means of the joint 2, the second hinge part 4 is pivoted together with the door 5 relative to the first hinge part 3, wherein the joint 2 and a part of the first hinge part 3 connected thereto is inserted into the second hinge part 4 in the fully closed state of the hinge 1 in FIG. 1C.

Figure 2:
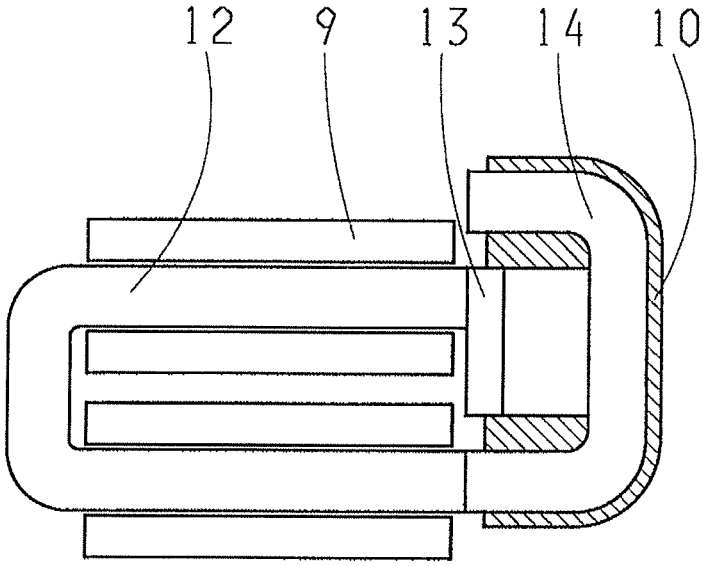
FIG. 2 A schematic view of a generator unit of the hinge assembly according to the invention according to FIG. 1A to 1C.

As can also be seen in FIG. 1A to 1C, an autonomous remote switch unit 6 comprising a radio unit 7 and a generator unit 8 is disposed on the first hinge part 3 to the side of the hinge 1 and a plane running through the two hinge parts 3 and 4. The generator unit 8 is designed as an electrodynamic generator comprising a coil pack 9, a magnet block, 10 and a tongue 11 that is spring mounted on a housing of the generator unit 8 and connected to the magnet block 10. By means of the tongue 11, the magnet block 10 can be shifted into an actualization device when externally actuated which triggers the induction of a current pulse in the coil pack 9 oriented perpendicular to this actuation device. As becomes clear in combination with FIG. 2, this is achieved by reversing the pulse of the coil core 12 of the coil pack 9 by shifting the magnet block 10 which results in a change of the magnetic field within the coil pack 9 and induces a current pulse. To this end, the magnet block 10 possesses two opposite poles 13 and 14, of which one pole 14 is designed in U-shape. When the tongue 11 is in an unloaded state, one pole 13 is in contact with one end of the coil core 12 which is also designed in a U-shape, and the other pole 14 is in contact with the other end of the coil core 12. If, upon actuating the tongue 11, the magnet block 10 is thereby shifted in the direction of actuation, the pole 13 comes into contact with the other end of the coil core 12, whereas the U-shaped pole 14 is connected at its opposite end to the now released end of the coil core 12. This triggers the current pulse, and when the tongue 11 of the magnet block 10 is released, it is moved back into the initial position depicted in FIG. 2 due to the spring-loaded mounting of the tongue 11 which causes a new reversal of polarity and a new current pulse. These current pulses are then used to supply current to the radio unit 7 which subsequently transmits data to a higher-level reception unit, which is not further illustrated in this case.

The tongue 11 is actuated in the first preferred embodiment according to FIG. 1A to 1C by a projecting part 15 on the second hinge part 4 which can, for example, be a mounting flange to be screwed to the door 5. When the hinge 1 transitions into the closed state, this projecting part 15 presses against the tongue 11 as shown in FIG. 1C, thereby causing the shift of the magnet block 10 and the already described current induction in the generator unit 8. Upon moving back into the position shown in FIG. 1A, the tongue 11 springs back and thereby enables the induction of an additional current pulse. Overall, the tongue 11 can also be designed so that it offers a specific resistance to the movement of the second hinge part 4 into the position shown in FIG. 1C and thereby dampens the closing of the hinge 1 and hence also the door 5.

Figure 3:
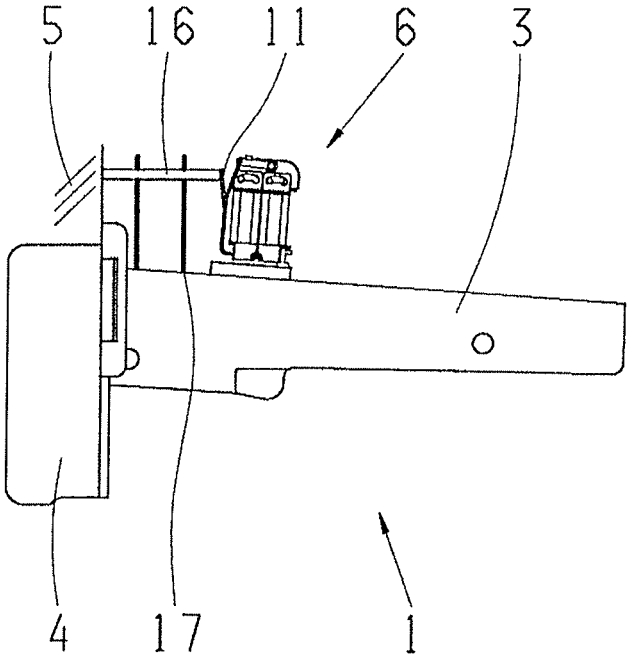
FIG. 3 A side view of a second preferred embodiment of the hinge assembly according to the invention shown in a closed position.

A second preferred embodiment of the hinge assembly according to the invention is revealed in FIG. 3 which depicts a closed position of the hinge 1. In contrast to the variation described above, the autonomous remote switch unit 6 is arranged in this case on the first hinge part 3 lying in the plane running through the two hinge parts 3 and 4. Furthermore, the tongue 11 in this case is actuated by an intermediate transmission (transfer) element 16 that establishes indirect contact between the tongue 11 and the door 5. The transmission (transfer) element 16 is movably guided in a slot 17 in the first hinge part 3, and one of its ends is in contact with the tongue 11, whereas its opposite end enters into contact with the door 5 when the hinge closes. Given this contact with the door 5, the transmission (transfer) element 16 is moved in the slot 17 towards the autonomous remote switch unit 6, and thereby actuates the tongue 11. If the door 5 and hence the hinge 1 is reopened, the tongue 11 relaxes, and pushes the transmission (transfer) element 16 of the door 5 back until the initial position of the tongue 11 has been reached. In this case as well, it is alternately conceivable to design the tongue 11 to generate damping when the hinge 1 transitions into the closed position.

Figure 4:
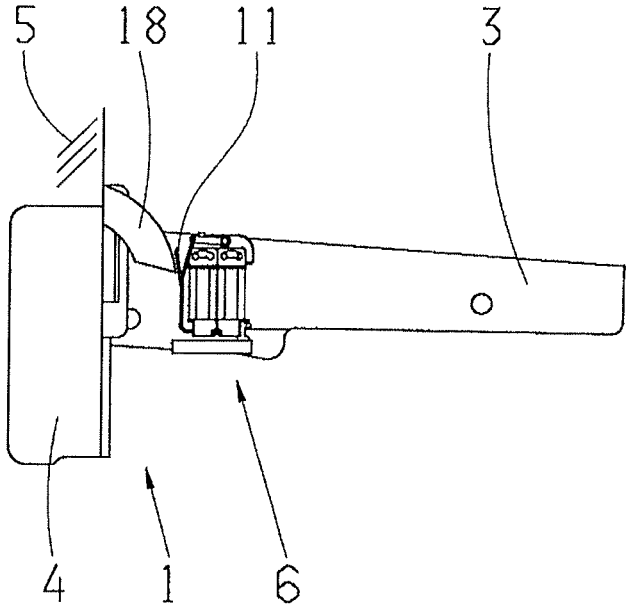
FIG. 4 A side view of a third preferred embodiment of the hinge assembly according to the invention shown in a closed state of the hinge assembly.

An additional third preferred embodiment of the invention is depicted in FIG. 4. In contrast to the embodiment according to FIG. 1A to 1C, the tongue 11 of the autonomous remote switch unit 6 does not directly contact the second hinge part 4; instead, this contact is established by means of an intermediate transmission (transfer) element 18 that is affixed to the door 5 and the second hinge part 4 and has a curved contour. This curved contour is selected so that even pressure is realized against the tongue 11 despite the pivoting of the second hinge part 4 and the door 5 relative to the first hinge part 3. In this case as well, a damping of movement can be realized by a corresponding design of the tongue 11.

Figure 5:
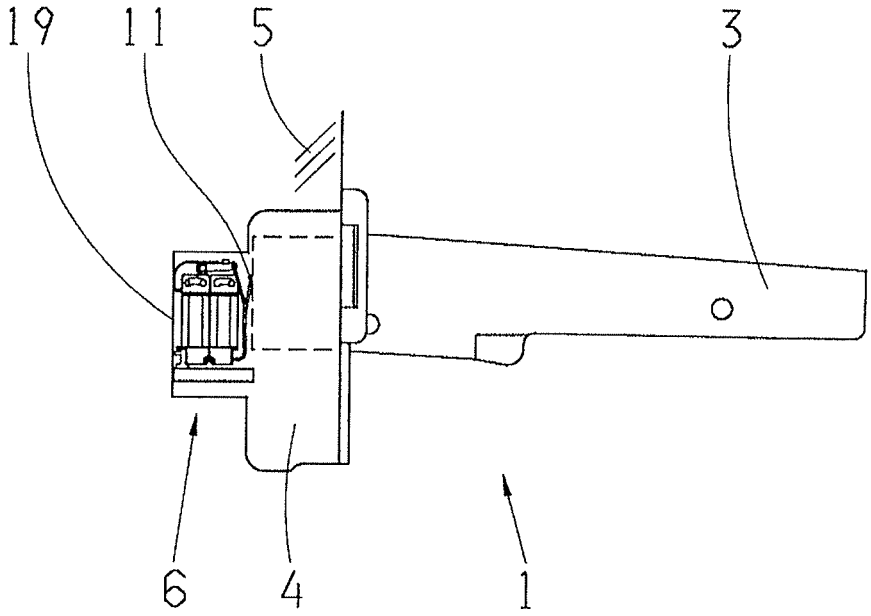
FIG. 5 A side view of a fourth preferred embodiment of the hinge assembly according to the invention shown in a closed state.

Furthermore, FIG. 5 discloses a fourth preferred embodiment of a hinge assembly according to the invention. This differs from the hinge assembly according to the first preferred embodiment in that the autonomous remote switch unit 6 in this case is placed on the side of the second hinge part 4 and the door 5 and enters into contact with the first hinge part 3 by means of the tongue 11 when the hinge 1 closes. To this end, the autonomous remote switch unit 6 is integrated in a recess 19 of the second hinge part 4, wherein the autonomous remote switch unit 6 is placed with the tongue 11 oriented toward the first hinge part 3. In this case as well, damping can be realized by means of the tongue 11.

Figure 6:
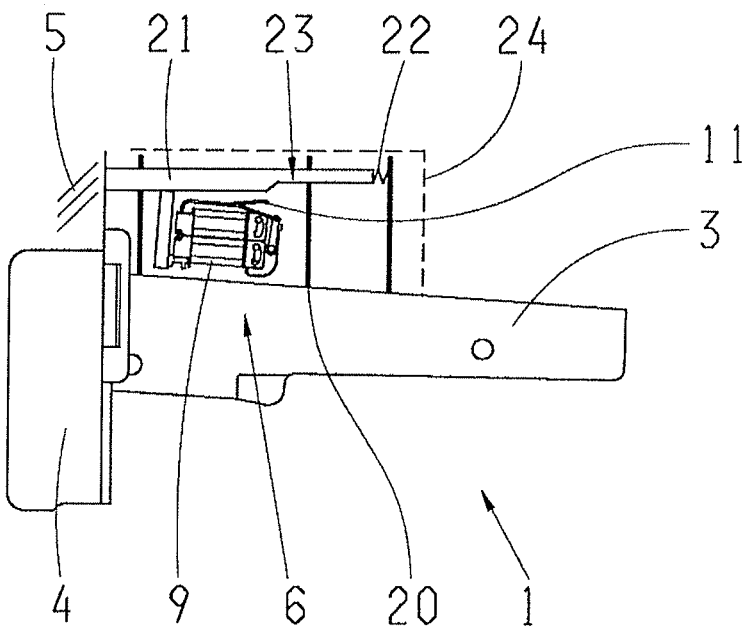
FIG. 6 A side view of a fifth preferred embodiment of the hinge assembly according to the invention shown in a closed state.

Lastly, FIG. 6 reveals a fifth preferred embodiment of a hinge assembly according to the invention, wherein the autonomous remote switch unit 6 is again placed on the first hinge part 3 lying in a plane running through the two hinge parts 3 and 4, in differing from the first embodiment. Contact between the tongue 11 and the door 5 when the hinge 1 closes is realized in this case by means of a transmission (transfer) element 21 moveably guided in a slot 20 in the first hinge part 3 that is moved against a spring 22 by moving the door 5. Corresponding resistance is generated against closing the hinge 1 from the resistance of this spring 22, and the closing movement is accordingly dampened. To actuate the tongue 11 of the autonomous remote switch unit 6, a contour 23 is formed on the actuation element 21 in the form of a step which, given a specific amount of movement of the transmission (transfer) element 21, is pressed against the tongue 11 and thereby is responsible for inducing a current pulse as in the described variations. In contrast to the variations according to FIG. 3, the coil pack 9 of the autonomous remote switch unit 6 in this case is oriented in a direction of movement of the transmission (transfer) element 21. In order to prevent undesired impairment of the transmission (transfer) element 21 and the autonomous remote switch unit 6, the remote switch unit 6 and the transmission (transfer) element 21 are disposed in a common housing 24 on the first hinge part 3.

The embodiments according to the invention of a hinge assembly therefore make it possible to detect opening and closing of a hinge 1 with the assistance of a compactly designed autonomous remote switch unit 6, and to send this information to a higher level receiving unit. Within the context of the invention, it is also conceivable to connect the radio unit 7 of the remote switch unit 6 to additional sensors such as a temperature sensor in order to transmit additional information, in addition to the state of the hinge 1, in data packages, when there is a current pulse. Overall, a robust and reliable detection of the opening and closing of the assigned hinge 1 is realized with the different arrangements of the autonomous remote switch unit 6.

REFERENCE SIGNS

1 Hinge
2 Joint

3 First hinge part
4 Second hinge part
5 Door
6 Autonomous remote switch unit
7 Radio unit
8 Generator unit
9 Coil pack
10 Magnet block
11 Tongue
12 Coil core
13 First pole
14 Second pole
15 Projection
16 Transmission element
17 Seat
18 Transmission element
19 Recess
20 Seat
21 Transmission element
22 Spring
23 Contour
24 Housing

The invention claimed is:

1. A hinge assembly comprising:

a hinge and an autonomous remote switch unit, the hinge comprising first and second hinge parts connected by an intermediate joint of which the first hinge part is connected to a stationary component, and the second hinge part is coupled, via the intermediate joint, to a pivoting element for pivoting relative to the first hinge part, the autonomous remote switch unit comprising a radio unit and a generator unit having an actuation element transmitting opening and closing of the hinge to the generator unit such that the generator unit induces an electrical current pulse to supply power to the radio unit, and the autonomous remote switch unit being arranged on the first hinge part, when the hinge closes, the actuation element comes into contact with either the second hinge part or the element to be pivoted, the generator unit being an electrodynamic generator with a coil pack and a magnet block, the coil pack being oriented perpendicular to a direction of actuation of the actuation element, and the magnet block, by moving across the actuation element, inducing a current pulse in the coil pack by an associated polarity reversal of a coil core, the generator unit being designed such that an electrical current pulse is induced through a transfer of both the opening and the closing of the hinge by the actuation element, the radio unit being designed to transmit data when power is supplied, and a transfer element being placed between either the second hinge part or the element to be pivoted, and the actuation element, and establishing contact between either the second hinge part, or the element to be pivoted, and the actuation element when the hinge closes.

2. The hinge assembly according to claim 1, wherein the transfer element is movably guided in a slot on the first hinge part and transmits the closing of the hinge by moving along the slot toward the actuation element.

3. The hinge assembly according to claim 2, wherein the transfer element moves against a spring in the slot when the hinge closes, and thereby actuates the actuation element via a contour.

4. The hinge assembly according to claim 2, wherein the transfer element is located in a common housing with the autonomous remote switch unit.

5. The hinge assembly according to claim 1, wherein the transfer element has a curved contour and is formed either on the second hinge part or the element to be pivoted.

6. The hinge assembly according to claim 1, wherein the actuation element is a spring-mounted tongue.

7. A hinge assembly comprising:

a cup hinge and an autonomous remote switch unit, wherein the cup hinge has first and second hinge parts, the first hinge part is connected to a stationary component and the second hinge part is connected to a door, the first and the second hinge parts are connected by an intermediate joint such that the second hinge part is pivotable, relative to the first hinge part, between an open position and a closed position, the autonomous remote switch unit comprises a radio unit and a generator unit having an actuation element, the actuation element communicates changes between the open and the closed positions of the second hinge part to the generator unit such that the generator unit induces an electrical current pulse to supply power to the radio unit, the autonomous remote switch unit is arranged on the first hinge part, the actuation element contacts either the second hinge part or the door when the second hinge part is in the closed position, the generator unit is an electrodynamic generator with a coil pack and a magnet block, the coil pack is oriented perpendicular to a direction of actuation of the actuation element, and the magnet block, by moving across the actuation element, induces a current pulse in the coil pack by an associated polarity reversal of a coil core, and the generator unit is designed such that an electrical current pulse is induced by the actuation element by changes between the open and the closed positions of the second hinge part, the radio unit transmits data when power is thereby supplied, and a transmission element is placed between either one of the second hinge part or the door and the actuation element, and establishes contact between the either one of the second hinge part or the door, and the actuation element when the second hinge part changes to the closed position.

* * * * *